US010488131B2

(12) United States Patent
Brinson

(10) Patent No.: US 10,488,131 B2
(45) Date of Patent: Nov. 26, 2019

(54) GAS BLOCK ALIGNMENT FIXTURE

(71) Applicant: David Glen Brinson, Houston, TX (US)

(72) Inventor: David Glen Brinson, Houston, TX (US)

( * ) Notice: Subject to any disclaimer, the term of this patent is extended or adjusted under 35 U.S.C. 154(b) by 0 days.

(21) Appl. No.: 16/403,798

(22) Filed: May 6, 2019

(65) Prior Publication Data

US 2019/0257603 A1 Aug. 22, 2019

Related U.S. Application Data

(63) Continuation of application No. 15/964,809, filed on Apr. 27, 2018, now abandoned.

(60) Provisional application No. 62/505,083, filed on May 11, 2017.

(51) Int. Cl.

| | |
|---|---|
| ***F41A 11/00*** | (2006.01) |
| ***F41A 5/28*** | (2006.01) |
| ***F41A 5/26*** | (2006.01) |

(52) U.S. Cl.

CPC *F41A 5/28* (2013.01); *F41A 5/26* (2013.01); *F41A 11/00* (2013.01)

(58) Field of Classification Search

CPC ..... F41A 5/26; F41A 5/22; F41A 5/24; F41A 5/18; F41A 11/00

See application file for complete search history.

(56) References Cited

U.S. PATENT DOCUMENTS

| | | | | |
|---|---|---|---|---|
| 5,945,626 | A | 8/1999 | Robbins | |
| 8,701,543 | B2 | 4/2014 | Brinkmeyer et al. | |
| 9,410,756 | B2 | 8/2016 | Gardner et al. | |
| 9,523,543 | B1 * | 12/2016 | Brown | F41A 5/26 |
| 9,903,675 | B2 * | 2/2018 | Cassels | F41A 5/28 |
| 2010/0275770 | A1 | 11/2010 | Noveske | |
| 2011/0179945 | A1 | 7/2011 | Clark et al. | |
| 2013/0098235 | A1 * | 4/2013 | Reinken | F41A 5/28 89/193 |
| 2014/0076149 | A1 | 3/2014 | Adams | |
| 2014/0076150 | A1 * | 3/2014 | Brinkmeyer | F41A 5/28 89/193 |
| 2015/0253091 | A1 | 9/2015 | Gardner et al. | |
| 2016/0273861 | A1 | 9/2016 | Langenbeck | |

FOREIGN PATENT DOCUMENTS

| | | | |
|---|---|---|---|
| DE | 609371 | * | 2/1935 |

* cited by examiner

*Primary Examiner* — Stephen Johnson

(74) *Attorney, Agent, or Firm* — Wood Herron & Evans LLP

(57) ABSTRACT

Provided is a fixture for holding a firearm gas block for mounting or removal of a gas tube. holding fixture. The fixture includes an elongated body having a mounting portion and a holding portion. The mounting portion is sized to correspond to and receive a bore of a gas block and includes at least one attachment feature for temporary securement of a gas block placed thereon against rotational and axial movement relative to the body.

6 Claims, 5 Drawing Sheets

GAS BLOCK ALIGNMENT FIXTURE

RELATED APPLICATIONS

This application is a continuation application of U.S. patent application Ser. No. 15/964,809, filed Apr. 27, 2019, and claims priority to U.S. Provisional Patent Application No. 62/505,083, filed May 11, 2017, and incorporates the same herein by reference.

TECHNICAL FIELD

This invention relates to a fixture for firmly holding a gas block, such as for an AR-pattern firearm, in a secure and convenient position while attaching a gas tube with a roll pin.

BACKGROUND

Gas operated semiautomatic or fully automatic firearms use a portion of the propellant gas diverted from the barrel bore for automatically cycling the action each time a round is fired. Such firearms, including AR-pattern firearms, typically use a gas block that is mounted over a gas port in the barrel. The gas block may be mounted to the barrel and secured in place over the gas port, such as with set screws or pins. In a direct impingement gas system, a gas tube carries a flow of gas pressure from the gas block to the upper receiver where it is directed into a bolt carrier assembly. Connection of the gas tube to the gas block is commonly achieved by pressing a small roll pin through a cross bore in the gas block that aligns with openings adjacent the forward end of the gas tube. This holds a port in the wall of the gas tube in alignment with an internal gas passageway in the gas block.

Holding a gas block securely while holding the gas tube in the proper position and simultaneously driving a roll pin through the cross bore to secure the gas tube can be a challenging task. Gas blocks do not typically have flat sides, making it difficult to lay it on a flat surface during this installation process. Clamping the gas block in a vise can mar the finish or otherwise damage the gas block. Moreover, gas blocks come in a variety of external sizes, styles, and shapes, some being low profile, some including an integral front site, and others including an accessory mounting rail. Accordingly, a wide variety of jigs or fixtures would be needed to adapt to the varies external sizes and shapes.

A "universal" fixture that is simple, versatile, effective, and inexpensive is needed.

SUMMARY OF INVENTION

The present invention provides a fixture for holding a firearm gas block for mounting or removal of a gas tube. The fixture includes an elongated body having a mounting portion and a holding portion. The mounting portion is sized to correspond to and receive a bore of a gas block and includes at least one attachment feature for temporary securement of a gas block placed thereon against rotational and axial movement relative to the body.

According to one embodiment, the mounting portion can be substantially round in cross section. The attachment feature can be, for example, one or more dimples for receiving a gas block set screw and/or one or more transverse slots for receiving a gas block taper pin or roll pin. According to another feature of one embodiment, the holding portion may include one or more flats for clamping the fixture in a holding device. According to yet another embodiment, the mounting portion can include multiple segments having different diameters to accommodate gas blocks for barrels of different diameters using the same fixture.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures; wherein.

DETAILED DESCRIPTION

Figure 1:
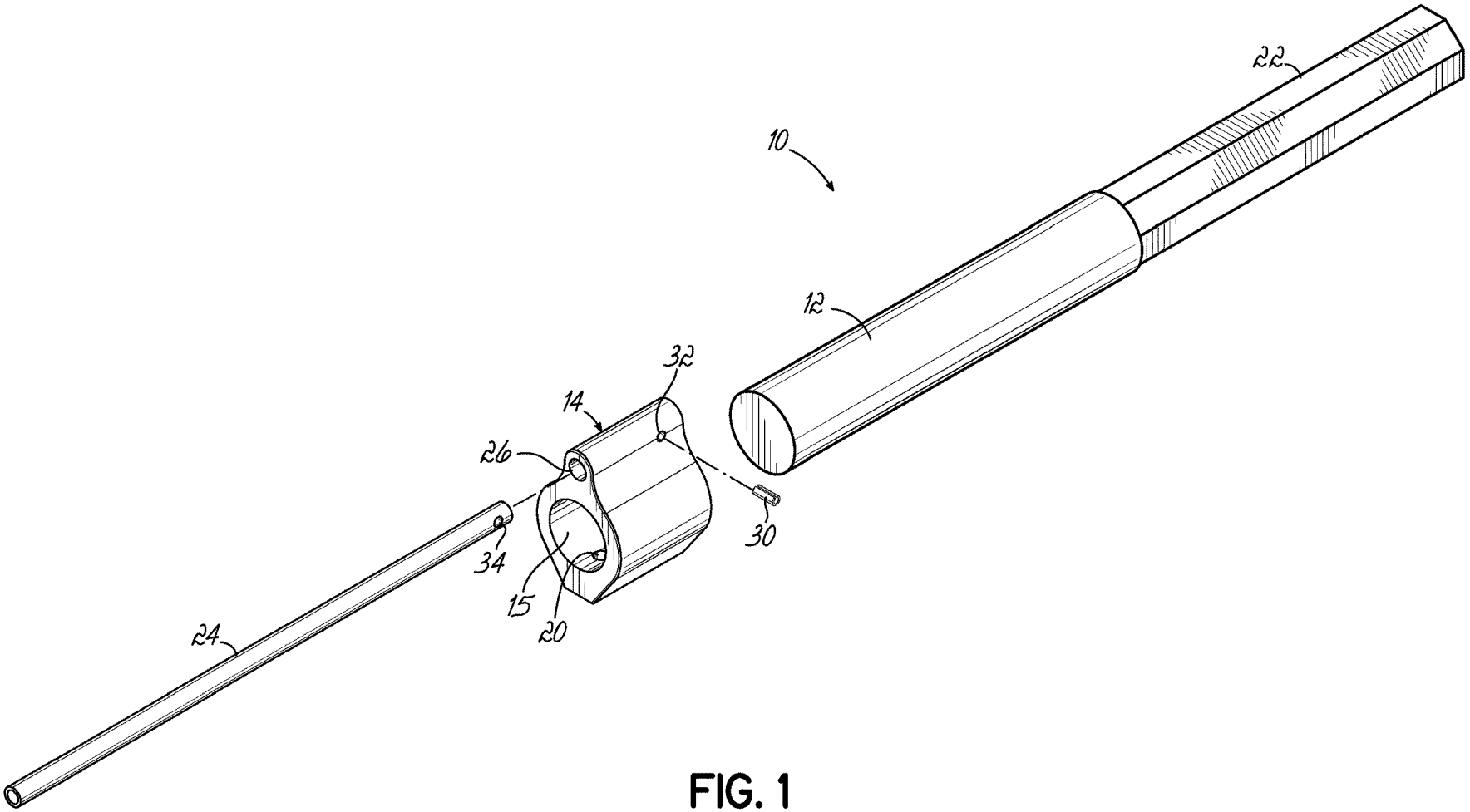
FIG. 1 is an isometric exploded view showing a fixture according to one embodiment of the present invention in relation to a gas block, gas tube, and assembly roll pin.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
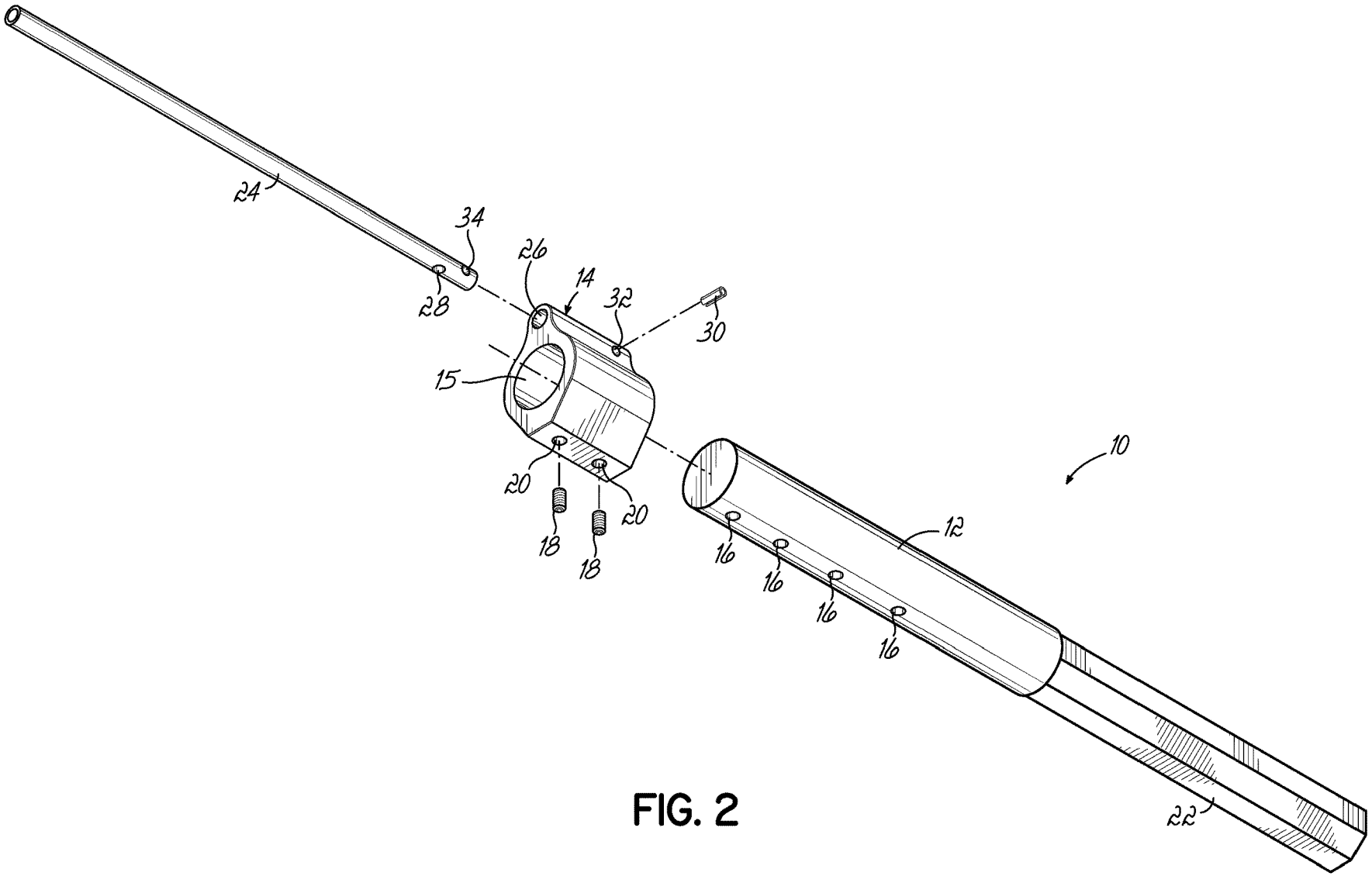
FIG. 2 is an underside isometric view thereof.

Referring first to FIGS. 1 and 2, therein is shown a fixture 10 according to a first embodiment of the present invention. The fixture 10 is generally in the form of an elongated bar or rod having a mounting portion 12 that may be generally round in cross section and sized to replicate the diameter of a firearm barrel where a gas block 14 is to be mounted. A gas block 14 has a through-bore 15 that is slid over the barrel to a position in alignment with the barrels gas port. In AR-pattern firearms, the most common barrel outside diameter where the gas block is mounted is 0.750" (nominal). Some thin or "pencil" barrels may have a diameter of 0.625" in this region. Still other heavy or "bull" barrels may use a gas block mounted on a barrel portion that is 0.875" or 0.936" in diameter. Although making the mounting portion 12 of the fixture 10 circular in cross section may be most convenient and easiest to manufacture, it could be another shape, such as oval or polygonal, that will firmly support a gas block 14 being temporarily mounted thereon. The diameter or major cross-sectional dimension of the mounting portion 12 may be slightly undersized (such as by about 0.010") to allow for variance/tolerance of gas block through-bore 15 sizes and to avoid any marring of the gas block coating or finish, even on the inside.

As shown in FIG. 2, the mounting portion 12 may include a series of features, such as dimples 16, spaced along its length (or around its circumference). These dimples are configured to receive a set screw 18 inserted into one or more of the threaded openings 20 in the gas block 14. Set screws are a commonly used means to secure the gas block to the barrel in the proper location and orientation over the barrel's gas port. Likewise, one or more set screws 18 may be used to secure a gas block 14 temporarily in place on the mounting portion 12 of the fixture 10 to prevent axial and rotational movement thereon. The series of dimples 16 can be spaced to correspond to common spacings used for the threaded openings 20 in gas blocks 14 so that multiple set screws 18 may be used, each being seated in a corresponding dimple 16. Accordingly, the mounting portion 12 may be longer than necessary to secure a gas block 14 thereon, with adjacent pairs of dimples 16 having varied spacings corresponding to the various standard or common set screw spacings found in gas blocks. Alternatively, if the spacing of dimples 16 does not match pairs of threaded openings 20 for a particular gas block, a single set screw 18 may be used and will provide adequate securement for use of the fixture 10.

The mounting portion 12 could be made shorter in length than in the illustrated embodiment, if differently spaced pairs of dimples 16 (and/or other attachment features) are positioned around its circumference rather than along its length. Because the fixture indexes only to the interior diameter of the gas block bore 15, a close tolerance dimension of the part with both ends necessarily open, the fixture 10 can be used on any type/style of gas block, including those with unusual shapes, those that include a front sight or accessory rail, and those that are split or clamp onto the barrel.

Another well-known means for securing a gas block to a barrel uses transverse taper pins or roll pins driven into transverse openings in the gas block that partially intersect the barrel through slots drilled or cut in the barrel's surface. Accordingly, the mounting portion 12 of the fixture 10 could be configured with slots (not shown) or features other than dimples 16 to accommodate such other gas block mounting configurations or means.

The fixture 10 also includes a holding portion 22, which allows the fixture 10 and temporarily mounted gas block 14 to be manipulated by hand or clamped in a support or holding device, such as a bench vise (not shown). The holding portion 22 may be substantially round, may be in the form of a blade, or may include a series of flat surfaces to facilitate clamping the fixture 10 in various selected orientations. In the illustrated embodiment, the holding portion 22 is octagonal in cross section, although having as few as a single flat surface at a selected position can aid in clamping the fixture 10 in an orientation selected by the installer. Alternatively, user orientation could be a function of selecting attachment features (e.g., dimples 16) that are positioned around the circumference of the mounting portion 12, instead of changing the position of the holding portion 22 in the holding device.

Figure 3:
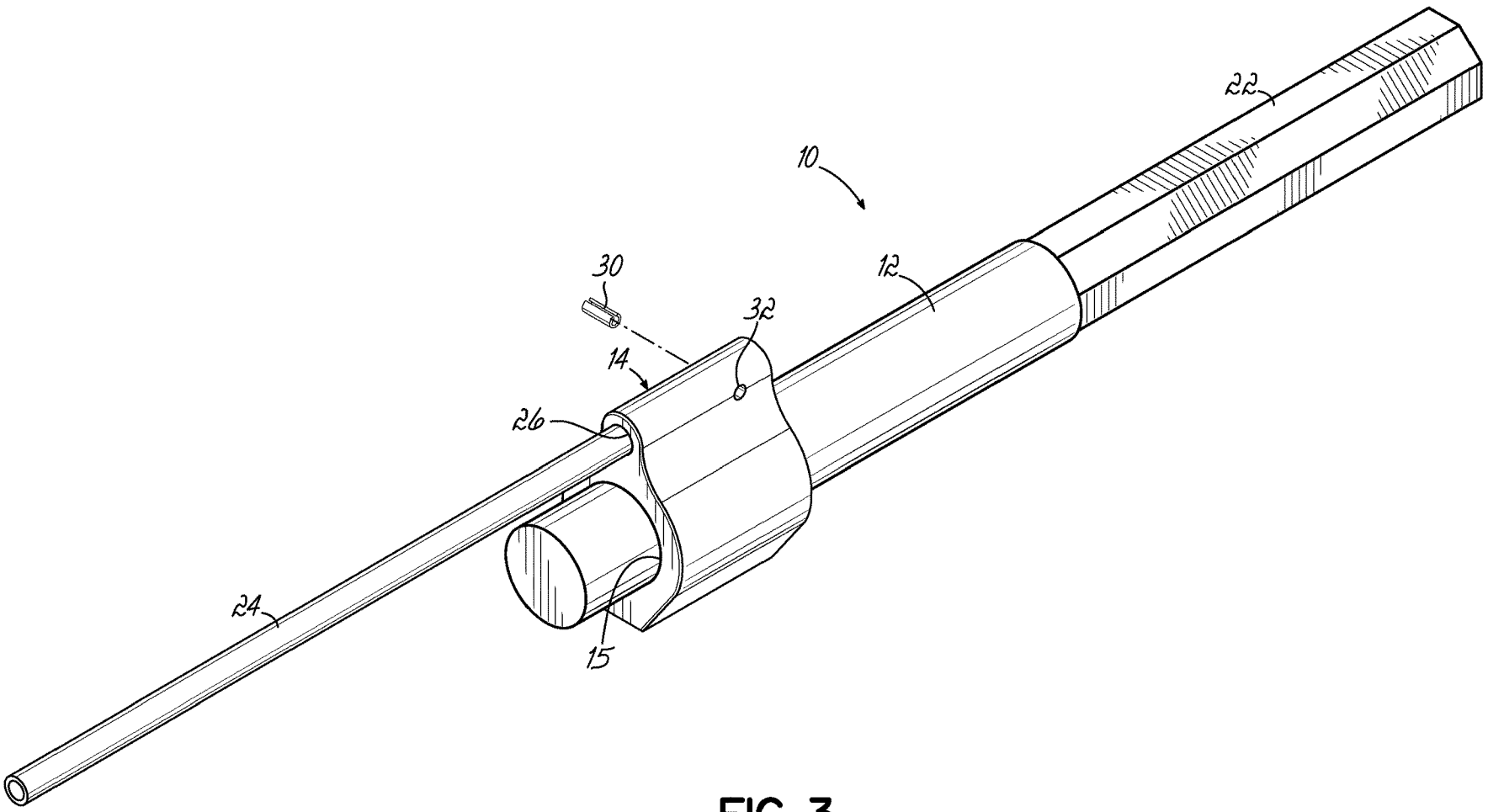
FIG. 3 is an isometric view showing a fixture showing holding a gas block while a gas tube is being installed.
Figure 4:
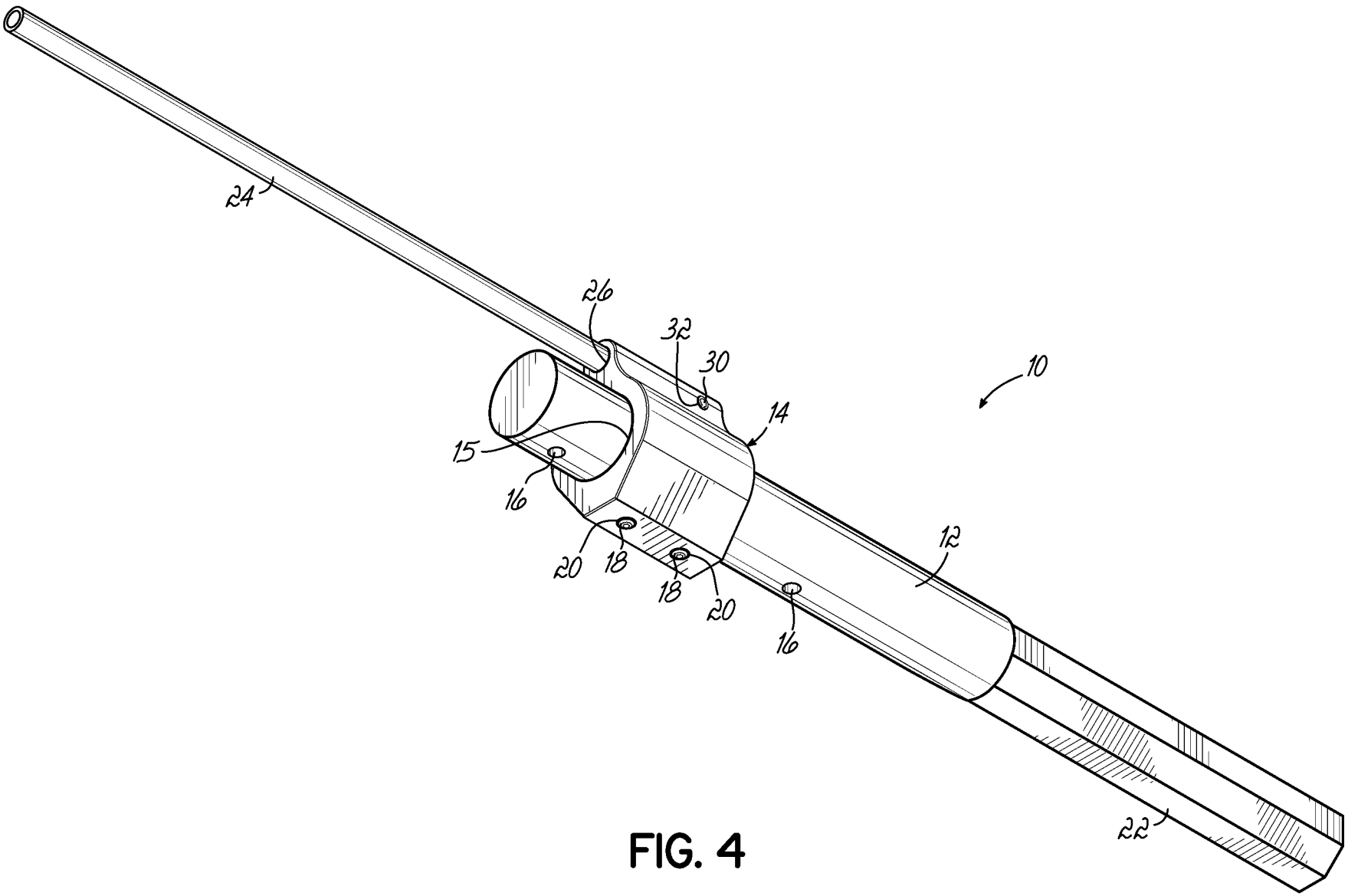
FIG. 4 is an underside isometric view after installation.

Referring now also to FIGS. 3 and 4, once the gas block 14 has been temporarily secured to the mounting portion 12 and the fixture 10 supported (such as in a vise) at the desired angle, a gas tube 24 may be attached to the gas block 14 with relative ease. The gas block 14 includes a second bore 26 generally parallel to and offset from the through-bore 15. The second bore 26 is either plugged at the forward end or does not go all the way through the gas block 14 (i.e., a blind end bore). An internal gas passageway (not shown) connects the through-bore 15 and the second bore 26 and is aligned with the barrel's gas port when installed on a barrel. The gas tube 24 may be straight (as shown) or include an offset bend (not shown), such as for use with low profile gas blocks 14. The gas tube 24 includes a port 28 in its wall that aligns with the internal gas passageway when the gas tube 24 is inserted into the second bore 26 of the gas block 14. The most common way of attaching a gas tube 24 to a gas block 14 is by inserting a roll pin 30 through a cross bore 32 that corresponds to a pair of laterally aligned openings 34 adjacent the forward end of the gas tube 24. After the gas tube 24 is inserted into the second bore 26, while holding the openings 34 in alignment with the cross bore 32 of the gas block 14, the roll pin 30 may be inserted with a common roll pin tool or starter punch (not shown) and driven into place (FIG. 4) with a common driver punch and/or seating punch. Likewise, the fixture 10 may be used for removing an attached gas tube 24 by holding the gas block 14 as the roll pin 30 is driven out with a needle punch. Having multiple opposed flats on the holding portion 22 allows the fixture 10 and mounted gas block 14 to be positioned so the roll pin 30 is driven horizontally, vertically, or at an angle in between, depending on what is comfortable to the installer, whether the holding device (e.g., vise) is high/low and whether the installer is seated or standing.

Figure 5:
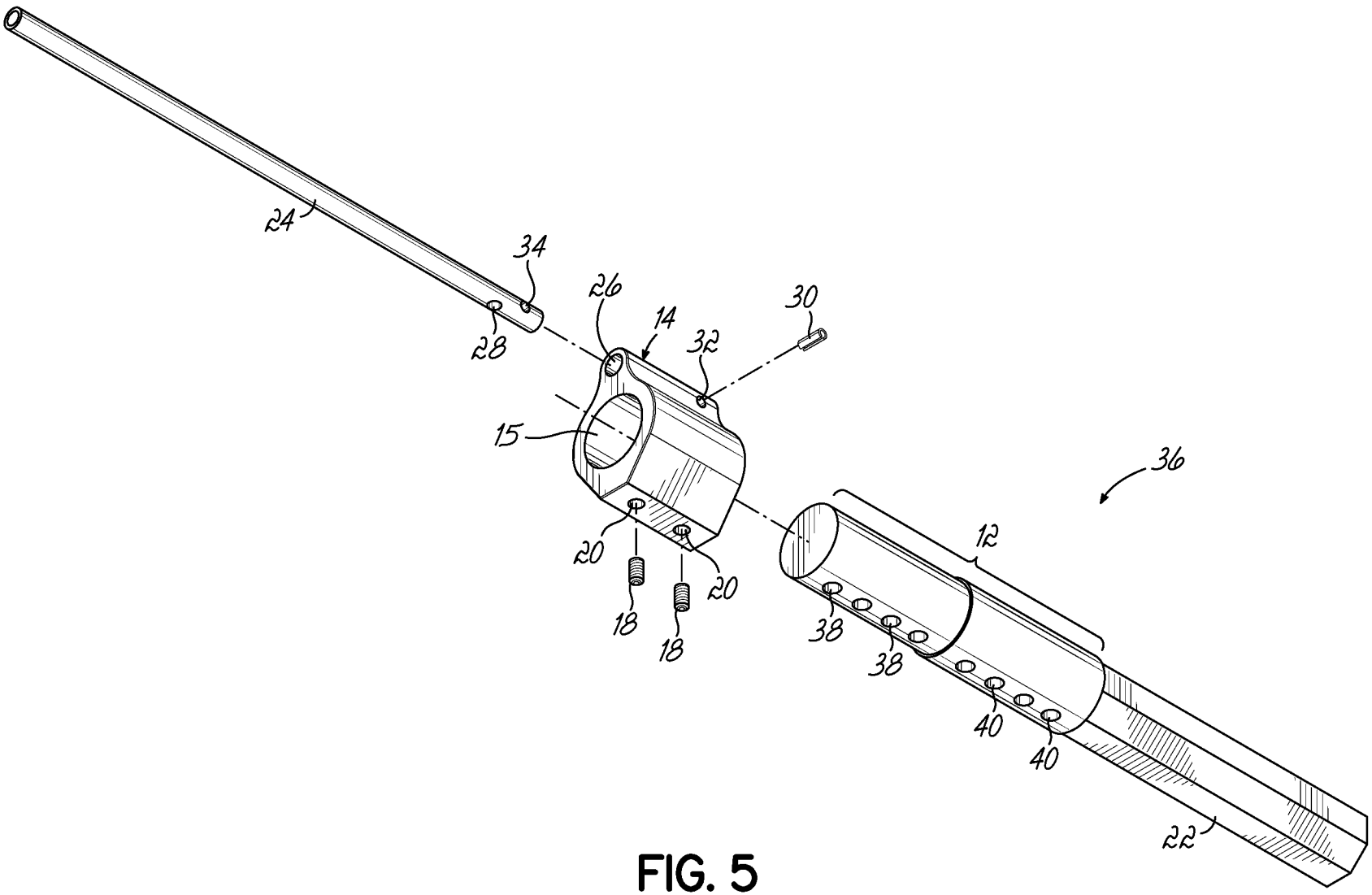
FIG. 5 is an underside isometric exploded view showing an alternate embodiment of the present invention.

Referring now to FIG. 5, therein is shown a fixture 36 according to another embodiment of the invention. In this embodiment, the mounting portion 12 may include multiple sized (diameter) segments 38, 40 so that a single fixture 36 may be used for holding multiple sizes (bore diameters) of gas blocks 14. The fixture 36 functions and is used as described above, with the user sliding the gas block 14 to the corresponding segment 38, 40 of the mounting portion 12.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A method of assembling a plurality of gas tube/gas block assemblies before installation onto a firearm barrel, comprising the steps of:

a) providing an elongated fixture body having a mounting portion and a holding portion, the mounting portion sized to correspond to and receive a bore of a first gas block and including at least one attachment feature for temporary securement of the first gas block placed thereon against rotational and axial movement relative to the fixture body;

b) placing the first gas block onto the mounting portion of the fixture body and temporarily securing the first gas block thereon against rotational and axial movement relative to the fixture body using the attachment feature of the fixture body;

c) installing a first gas tube to the first gas block while the first gas block is temporarily secured to the fixture body;

d) removing the first gas block/gas tube assembly from the fixture body;

e) repeating steps b-d with a second gas block and second gas tube to assemble a second gas block/gas tube assembly;

f) installing the first and second gas block/gas tube assemblies onto firearm barrels.

2. The method of claim 1, wherein the attachment feature includes at least one dimple for receiving a gas block set screw.

3. The method of claim 1, wherein the holding portion includes a longitudinal side having at least one flat surface and further comprising a step of clamping the flat surface of the fixture body in a holding device.

4. The method of claim 1, wherein the mounting portion includes a first segment having a first size and a second segment having a different second size, and wherein the first gas block is placed and temporarily secured on the first segment and the second gas block a bore of a different size than the first gas block and is placed and temporarily secured on the second segment.

5. The method of claim 4, the first segment corresponds to a 0.625" barrel diameter and the second segment corresponds to a 0.750" barrel diameter.

6. The method of claim 4, wherein the first segment corresponds to a 0.875" barrel diameter and the second segment corresponds to a 0.936" barrel diameter.

* * * * *